United States Patent [19]

Bosch

[11] 4,032,260

[45] June 28, 1977

[54] HYDRAULIC CONTROL DEVICE

[75] Inventor: Paul Bosch, Ludwigsburg, Germany

[73] Assignee: Robert Bosch G.m.b.H., Stuttgart, Germany

[22] Filed: Feb. 4, 1976

[21] Appl. No.: 655,215

[30] Foreign Application Priority Data

Feb. 12, 1975 Germany ..... 2505778

[52] U.S. Cl. ..... 417/216; 417/218; 417/221; 60/449; 60/452

[51] Int. Cl.[2] ..... F04B 1/06; F16D 31/02

[58] Field of Search ..... 417/216, 218, 219, 221, 417/222; 60/447, 449, 452

[56] References Cited

UNITED STATES PATENTS

| | | | |
|---|---|---|---|
| 3,891,354 | 6/1975 | Bosch | 60/449 |
| 3,935,706 | 2/1976 | Stevens | 60/452 |

FOREIGN PATENTS OR APPLICATIONS

| | | | |
|---|---|---|---|
| 1,959,409 | 6/1971 | Germany | 60/449 |

*Primary Examiner*—Carlton R. Croyle

*Assistant Examiner*—G. P. LaPointe

*Attorney, Agent, or Firm*—Michael J. Striker

[57] ABSTRACT

A hydraulic control device for protecting a drive from excess loading conditions includes at least one pump having adjustable members for controlling the quantity of fluid transported by the pump. A pressure-responsive control slide is mounted for movement relative to a housing and is moved towards respective positions, each of which corresponds to a normally loaded condition of the drive by a control pump which generates a pressure force which is indicative of the rpm of the drive at normally loaded conditions. The device further includes an arrangement for securing the control slide when the drive is subjected to loads in excess of the respective normally loaded conditions so that a valve member is permitted to move in response to excess loads relative to the control slide after the latter has been secured in said respective positions by the securing arrangement between switching positions in which the adjustable members are operative to adjust the quantity of fluid being transported by the pump.

23 Claims, 4 Drawing Figures

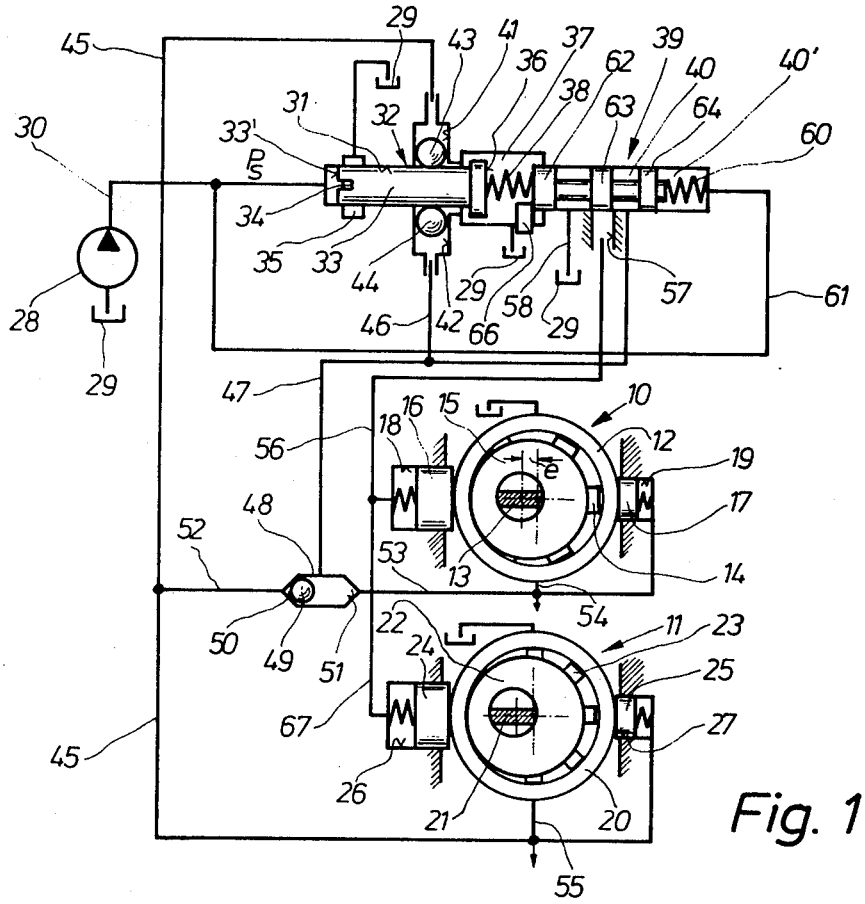
Fig. 1
Fig. 2
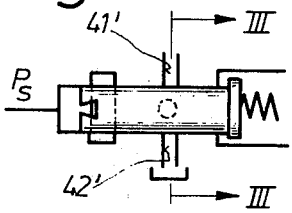
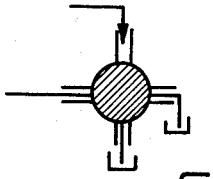
Fig. 3
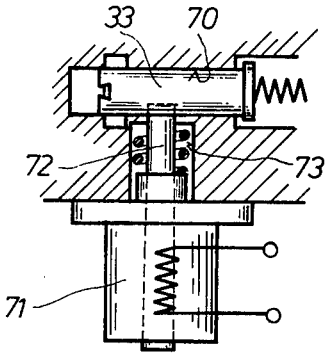
Fig. 4

HYDRAULIC CONTROL DEVICE

BACKGROUND OF THE INVENTION:

The invention relates generally to hydraulic control devices and, more particularly, to a device which protects a drive from excess loading conditions.

Such overload conditions originate from many factors; for example, additional hydraulic pumps may be suddenly connected to the drive or obstructions in the outlet pipes may develop, etc. However, the known devices for protecting a drive from such overload conditions have not proven altogether reliable or satisfactory in practice.

A common drawback of such prior-art devices is that there is great difficulty in establishing a predictable relationship between a predetermined desired speed for the drive and a predetermined cross-section for a throttle-type flow-restrictor. At present, one lever is provided for the adjustment of the desired rpm of the drive and another lever is provided for the adjustment of the flow-restrictor cross-section. It has proven very difficult to coordinate the movement of these levers so that the desired relationship between these two quantities can be employed in protecting the drive from undesirable overload conditions.

SUMMARY OF THE INVENTION:

Accordingly, it is a general object of the present invention to overcome the disadvantages of the prior art.

Another object of the present invention is to reliably protect a drive from loads in excess of the normally loaded condition thereof.

An additional object of the present invention is to generate a predetermined relationship between a desired speed for the drive and a cross-section for a flow-restrictor which can be used to protect a drive from undesirable overload conditions.

Still another object of the present invention is to eliminate the cumbersome mechanical linkage previously used in establishing a relationship between the desired speed of the drive and the cross-section of a flow-restrictor.

In keeping with these objects and with others which will become apparent hereinafter, one feature of the invention resides in a device for protecting a drive from excess loading conditions which comprises a housing; a pressure-responsive control slide mounted for movement relative to the housing; transporting means for transporting fluid, the transporting means being connected to a drive so as to normally load the latter and having adjusting means for controlling the quantity of fluid transported by the transporting means; means for generating a pressure force which is indicative of the rpm of the drive at respective normally loaded conditions and which is operative for moving the control slide towards respective positions, each of which corresponds to one of the normally loaded conditions; means for securing the control slide in its respective positions when the drive is subjected to loads in excess of the respective normally loaded conditions; and safety valve means including a valve member movable in response to excess loads relative to the control slide, after the latter has been secured in its respective positions by the securing means, between switching positions in which the adjusting means is operative to adjust the quantity of fluid transported by the transporting means.

Thus, in accordance with the invention, the control slide is moved towards different positions, each of which is indicative of the normally loaded condition of the drive at any one particular point in the operation thereof. As the rpm of the drive builds up, the greater will be the force generated and the further the control slide will move. It will be appreciated that the pressure force which moves the control slide is inversely proportional to the square of the cross-sectional dimensions which are presented to a fluid; in other words, the larger the cross-sectional area, the less resistance encountered by the fluid and the lower the pressure head generated. Therefore, since the control slide is normally freely movable during normally loaded conditions, a relatively constant pressure head is generated at each position assumed by the control slide.

In accordance with the invention, it is desired to arrest the control slide in one particular position and make use of the fact that the pressure force will decrease when the drive is subjected to overload conditions and its speed thereby reduced. This reduced pressure force, at overload conditions, is used to move a valve member relative to the fixed control slide between switching positions which will adjust the quantity of fluid being transported by the hydraulic system so that the drive is permitted to return to a non-overload condition.

The securement of the control slide is accomplished by various means. For example, hydraulic pressure alone may be directed towards the control slide for arresting it in a particular position. Alternatively, the hydraulic pressure generated by the transporting means may be employed to direct abutment members, such as balls, against the control slide for securing the latter. Still another method is embodied in electromagnetically energizing an armature for moving the latter against the slide and securing it in position relative to the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS:

FIG. 1 is a schematic view of the operation of the device in accordance with the present invention showing a preferred embodiment;

FIG. 2 is a schematic view of a detail of FIG. 1 showing another preferred embodiment;

FIG. 3 is a view, in partial vertical section, of FIG. 2 along the line having the arrows III—III; and FIG. 4 is a partial schematic view of a detail of FIG. 1 showing still another preferred embodiment.

DESCRIPTION OF THE PREFERRED EMBODIMENTS:

Referring firstly to FIG. 1 of the drawing, reference numeral 10 generally identifies a pump or means for transporting fluid, preferably but not necessarily a radial-piston, variable-output type pump. Pump 10 comprise a pintle 13, a cylinder block 15 which revolves around pintle 13 and contains the cylinders in which the displaceable members or pistons 14 operate, and a slide block 12 which is used to control the length of the piston strokes. A non-illustrated drive is secured to the cylinder block 15 for rotating the latter.

The amount of fluid pumped by pump 10 is determined by the amount of adjustment in distance provided between the centers of the slide block 12 and the cylinder block 15. The difference in distance, *e*, determines the length of the piston 14 stroke which, in turn, controls the amount of fluid flowing out of the cylinders towards the high-pressure side or outlet 54 through which the fluid is conducted towards a consumer.

This adjustment is automatically controlled to accommodate varying volume requirements during the operating cycle by hydraulically controlled large piston 16 and small piston 17 which are respectively movable in cylindrical cavities or bores 18 and 19. Pistons 16 and 17 are adapted to contact opposite sides of the slide block 12 and, depending upon the difference in pressure by these pistons, the distance *e* between centers is adjusted.

Reference numeral 11 identifies an analogous-type pump. This pump 11 comprises a slide block 20, pintle 21, cylinder block 22, pistons 23, large piston 24 in its bore 26, small piston 25 in its bore 27, and high-pressure side or outlet 55 which delivers fluid to a consumer.

Both pumps 10 and 11 are driven by the same non-illustrated drive, preferably but not necessarily by a common shaft. As noted above, the invention relates to protecting this drive from excessive loading conditions, particularly sudden loading conditions which tend to cause sudden torque changes which tend to overstress the drive shaft. Such excessive loading conditions can occur from a variety of factors; for example, when there is a sudden need for a great quantity of fluid to be transported towards outlet 54 and 55 because of an increased number of consumer applications, or because an obstruction has developed downstream of the pumps 10 and 11.

To protect the drive, it is necessary first to generate a pressure force which is indicative of the rpm of the drive. This force is also proportional to the loading condition that the drive is normally subjected to since the higher the load condition at the high-pressure sides of the pumps 10 and 11, the slower the rpm of the drive, and vice versa.

This pressure force is generated as follows:

Pumping means 28 is operative to pump fluid from a container 29 towards an inlet end of throttle valve housing 32 by means of conduit 30. A pressure-responsive control slide 33 is mounted in bore 31 for sliding movement therethrough relative to the housing 32. At the inlet end of housing 32, the control slide 33 has a force-impinging end 33′ formed with a notch or throttle-type opening 34. Notch 34 cooperates with the annular flow-through chamber 35 in order to restrict the flow as it returns to container 29.

At the other end of the housing 32, a valve member 39 is coaxially arranged with respect to the control slide 33. The valve member 39 is mounted in bore 40 for sliding movement. The end 62 of valve member 39 which projects into chamber 37 abuts against one end of the biasing means or spring 38; the end 36 of control slide 33 which also projects into chamber 37 is connected to the other end of spring 38. The interior of chamber 37 is in permanent communication with container 29.

Prior to moving the valve member 39 in response to excess loads, it is necessary to secure the control slide 33 so that the valve member 39 can move relative to the control slide 33. FIG. 1 shows one preferred means for actuating the securing means. Thus, bores 41 and 42 which extend transversely of the elongation of the control slide 33 at opposite sides thereof respectively accommodate abutment members or balls 43 and 44.

Bore 41 communicates by means of conduit 45 with the outlet 55 and bore 27 of pump 11. Similarly, bore 42 communicates by means of conduits 46 and 47 with the outlet 54 and bore 19 of pump 10. Switching means, preferably a two-way or changeover valve 48, is connected across the outlets 54 and 55 for selecting which of the latter pumps generates the greater pressure. Thus, one inlet of changeover valve 48 is connected to outlet 54 by means of pipe 53; the other inlet of changeover valve 48 is connected to conduit 45 by means of pipe 52.

In operation, the valve body 49 is movable into engagement with either valve seat 51 or 50 so as to interrupt the pressurized fluid flow from the respective outlets 54, 55 of pumps 10, 11. As illustrated, pump 10 has the greater output pressure so that the valve body 49 has been shifted towards the left, thereby establishing communication with outlet pipe 47. If the pump 11 had the greater output pressure, then the outlet 55 of pump 11 would be in communication with outlet pipe 47.

Turning now to the safety valve means, the valve member 39 comprises end 62 which abuts against spring 38, actuating end 64 which abuts against spring 60, and valve body 63 located intermediate ends 62 and 64. The valve body 63 overlies bore 57 and has a width which corresponds to the diameter of the mouth of bore 57. The spring 60 is located in inlet portion 40′ which is in constant communication with conduit 30 by means of pipe 61 so that the pressure force Ps generated by the pump 28 is simultaneously exerted against end 33′ of control slide 33 and end 64 of valve member 39. The function of spring 60, whose spring characteristic or resilience is much less than spring 38, is to constantly urge the valve member 39 against the spring 38. If spring 38 is entirely untensioned or relaxed, the weaker spring 60 urges the valve member 39 towards a stop 66 located at the right side of chamber 37.

To the left of bore 57, a pipe 58 has one end in communication with one portion of interior bore 40 that is located on the left side of valve 63 through which the valve member 39 is movable, and its other end in communication with a relatively low pressure source, such as container or reservoir 29. To the right of bore 57, a pipe 47 has one end in communication with another portion of interior bore 40 which is located on the right side of valve body 63. Pipe 56 has one end located inside of bore 57 itself, and its opposite end in hydraulic communication with bore 18 which accommodates large piston 16. Pipe 67 is connected to pipe 56 and connects bore 18 of pump 10 with bore 26 of pump 11.

As noted above, both pumps 10, 11 and the pump 28 are commonly driven by a non-illustrated prime mover or drive, for example, a synchronously driven diesel motor, just to mention one possibility. The pumps 10 and 11 transport fluid from a relatively low-pressure source, such as reservoir 29 which contains fluid at atmospheric pressure, and conveys it towards the respectively relatively high-pressure sides or outlets 54 and 55. The pressure prevailing in outlet 54 is sequentially propagated through pipe 53 and the changeover valve 48 towards the outlet pipe 47 when the output pressure of pump 10 is higher than the output pressure of pump 11. Simultaneously, the pipe 46 propagates the higher pressure of pump 10 towards ball 44 so as to urge the latter against the control slide 33. If the output pressure provided in outlet 55 is higher than that provided in outlet 54, then the valve body 49 is switched over from its illustrated position and the output pressure of pump 11 is therefore propagated towards outlet pipe 47.

In operation, the pump 28 generates a pressure force Ps which is proportional to the rpm or speed of the drive. The force Ps acts simultaneously upon flow-impinging end 33′ of control slide 33 and end 64 of valve member 39. Thus, the force Ps tend to compress the spring 38 and moves the pressure-responsive control slide 33 towards the right relative to housing 32 towards respective positions, each of which corresponds to the extent to which the drive is currently being loaded. That is, the pressurized fluid pumped by pump 28 flows through the notch 34 and pushes the control slide 33 away from its position overlying the flow-through chamber 35 since the pressure in front of the notch 34 is greater than that in the flow-through chamber 35. The total distance through which the control slide 33 moves is, of course, dependent upon the pressure head generated by the pump 28 which, in turn, is a function of the cross-section presented by the flow restriction. The higher the load, the lower the rpm is; and, in turn, the smaller the force Ps is, the smaller the distance through which the slide 33 will be moved. In short, the slide 33 is freely movable, during non-emergency or normally loaded conditions, towards many separate positions, each of which is indicative of how much the drive is being loaded.

When the drive is subjected to a load in excess of its normally rated load at a given rpm, the pump 10 must overcome a greater resistance at its outlet. In this event, the pressure at outlet 54 will build up. This increased pressure can be used to secure the control slide by propagating this pressure towards the ball 44. Eventually, a pressure value is reached whereat the ball 44 presses sufficiently affirmatively against the slide 33 so as to clamp it in position. Similarly, if the pump 11 is exposed to a greater resistance at its outlet 55, the increased pressure would cause the ball 43 to arrest the slide 33.

As noted above, if the pump 10 is exposed to higher loading conditions, the rpm of the drive decreases and the magnitude of the pressure force decreases at ends 33′ and 64. By arresting the control slide 33, it is possible to effect a proper and timely movement of the valve member 39. Thus, once the control slide 33 has been fixed by the increased pressure exerted by the balls, the pressure force existing at end 64 is reduced at excess loading conditions. The spring 38 located at the other end thereupon tends to push the valve member 39 towards the right. Since the control slide 33 is secured, end 36 now acts as a stationary abutment. Moreover, since the control slide 33 is secured, it is immaterial that the pressure force existing at end 33′ has also been reduced due to the excessive loading condition.

In this switched position of the valve member 39 towards the right, the fluid in bore 18 sequentially flows past pipe 56, bore 57, the interior bore portion to the left of valve body 63, pipe 58 and finally empties into reservoir 29. This operation relieves the pressure exerted by large piston 16 and, since the output pressure at 54 is constantly propagated towards bore 19, the smaller piston 17 is operative to push the slide block 12 towards the left. This reduces the distance *e* and cuts down the length of the displacement of the pistons, thus reducing the quantity of fluid transported by pump 10.

Since the pump 10 has been given less work to do, it requires less input energy from the drive so that now the rpm of the drive is allowed to increase until the magnitude of the pressure force Ps builds up again to a value sufficient to push valve member 39 back towards the left until the valve body 63 closes the mouth of bore 57.

The adjustment of pump 11 in this first switching position occurs in a completely analogous way since the bore 26 is connected to bore 18 by means of pipe 67.

As the pressure force Ps continues to build up everincreasing rpm, the pressure force acting on end 64 pushes the valve body 63 still further towards the left past the bore 57 so that communication is established between pipe 47 and pipe 56. In this second switching position, the fluid at outlet 54 sequentially flows past changeover valve 48, outlet pipe 47, the interior bore portion 40 to the right of valve body 63, pipe 56 and finally empties into bore 18. This operation intensifies the force exerted by large piston 16 and, since the force existing at outlet 54 which is constantly propagated towards bore 19 is lower than the force exerted by larger piston 16 due to the difference in the size of the contact surfaces of the pistons 16 and 17, the slide block 12 is moved towards the right. This increases the distance *e* and increases the output volumetric flow rate (e.g., gallons/minute) to be transported. The rpm of the drive is thus permitted to slow down.

The adjustment of pump 11 in this second switching position is again similar. It must be kept in mind, however, that the changeover valve 48 selects which pump has the higher outlet pressure. It is the selected pump, 10 or 11, whose pressurized fluid flows into pipe 47 towards the valve member 39.

Another preferred embodiment for securing the control slide is shown in FIGS. 2–3. Therein, bores 41′ and 42′ are located substantially normally of the elongation of the control slide 33. As before, pressurized fluid in bore 41′ is directed against the control slide 33 and collected in reservoirs 29 on the opposite side of the slide 33. However, in contrast to the embodiment shown in FIG. 1, no abutment members are used. It is the hydraulic force of the fluid itself which is used in this embodiment to arrest the slide 33. In order to further increase the securement of the slide, another set of bores is radially arranged with respect to the control slide for directing additional amounts of pressurized fluid towards the outer surface of the slide.

FIG. 4 illustrates still another preferred embodiment for securing the control slide. Control slide 33 moves relative to bore 70 and is arrested by electromagnetic means which is comprised of the electromagnet 71 and its armature 72. When the electromagnet 71 is actuated, the armature 72 moves relative to its bore 73 into engagement with the outer surface of slide 33. Preferably, the slide 33 is formed with a recess which is adapted to receive the leading end of the armature 72. The electromagnet 71 can be actuated manually, for example by closing a switch or by pulling a mechanical lever whose position controls the rpm of the drive, or automatically by the pressure forces existing at the outlets of the pumps 10 and 11. The adjustment of the pumps 10 and 11 is not to be restricted to the manner illustrated. For example, pump 11 can also be synchronously adjusted with pump 10 by mechanical interconnection therewith, rather than by simple hydraulic means.

In this connection, it will be understood that the above-described protective device can be employed in a hydraulic system employing one or more pumps. It is preferable if each of such pumps has its own means for securing the control slide. Each additional pump is either manually independently adjustable with respect to the first pump, or each pump can be adjusted in sequence.

In order to simplify the start-up operation of the drive, the spring 60 preferably has a spring constant relative to the spring constant of the spring 38 so that the valve member 39 is pre-biased into the switching position in which communication is established between bore 57 and pipe 58.

It will be understood that each of the elements described above, or two or more together, may also find a useful application in other types of constructions, differing from the types described above.

While the invention has been illustrated and described as embodied in a hydraulic control device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for protecting a drive from excess loading conditions, comprising a housing; a pressure-responsive control slide mounted for movement relative to said housing; transporting means for transporting fluid, said transporting means being connected to a drive so as to normally load the latter and having adjusting means for controlling the quantity of fluid transported by said transporting means; means for generating a pressure force which is indicative of the rpm of the drive at respective normally loaded conditions and which is operative for moving said control slide towards respective positions each of which corresponds to one of said normally loaded conditions; means for securing said control slide in said respective positions when said drive is subjected to loads in excess of said respective normally loaded conditions; and safety valve means including a valve member movable in response to excess loads relative to said control slide, after the latter has been secured in said respective positions by said securing means, between switching positions in which said adjusting means is operative to adjust the quantity of fluid transported by said transporting means.

2. The device of claim 1, wherein said control slide and said valve member are coaxially arranged with respect to each other in said housing along a line extending in direction of their movement; and further comprising biasing means located intermediate said valve member and said control slide and connected with the latter.

3. The device of claim 1, wherein said generating means includes flow-restricting means having a throttle-type opening formed on a force-impinging end of said control slide and a flow-through chamber; and wherein said generating means further includes pumping means driven by the drive and operative for conducting pressurized fluid against said force-impinging end so as to establish communication between said opening and said flow-through chamber by moving said control slide towards said respective positions thereof.

4. The device of claim 3, wherein said valve member has an actuating end also connected to said pumping means and facing away from said force-impinging end of said control slide.

5. The device of claim 1; and further comprising means for actuating said securing means, said actuating means being operative for directing pressurized fluid against said control slide so as to arrest the same in said respective positions when said drive is subjected to excess loads.

6. The device of claim 1; and further comprising means for actuating said securing means including a pressure-responsive abutment member, said actuating means being operative for directing pressurized fluid against said abutment member into engagement with said control slide so as to arrest the same in said respective positions when said drive is subjected to excess loads.

7. The device of claim 6, wherein said pressure-responsive abutment is ball-shaped.

8. The device of claim 1; and further comprising electromagnetic means for actuating said securing means.

9. The device of claim 8, wherein said electromagnetic means includes an electromagnet, a movable armature and energizing means for said electromagnet, said energizing means being operative for moving said armature into engagement with said control slide so as to arrest the same in said respective positions.

10. The device of claim 9, wherein said energizing means is manually operated.

11. The device of claim 1, wherein said transporting means comprises at least two variable-output pumps and said securing means comprises for each pump a bore extending transversely of the direction of movement of said control slide and an abutment member movably mounted in said bore, each of said pumps having a high-pressure side which communicates with said respective bores for moving the respective abutment member in direction transversely of said control slide.

12. The device of claim 11, wherein each of said abutment members are located on opposite sides of said control slide.

13. The device of claim 11; and further comprising switching means connected to said high-pressure sides of said pumps and operative for selecting which pump generates the relatively greater pressure at its high-pressure side so that the selected pump communicates with its respectively associated abutment member to secure said control slide.

14. The device of claim 13, wherein said switching means comprises a changeover valve.

15. The device of claim 1, wherein said transporting means comprises at least one variable-output pump having a high-pressure side through which fluid is transported towards a consumer.

16. The device of claim 15, wherein said adjusting means comprises a movable slide block; and further comprising means for displacing said block in dependence upon the switched position of said valve member.

17. The device of claim 16, wherein said valve member has a bore and a valve body which overlies said bore.

18. The device of claim 17, wherein said displacing means comprises a pair of hydraulically-actuated pistons each movably mounted in cylindrical cavities on opposite sides of said slide block, one of said cavities being in constant communication with said high-pressure source of said pump, and the other of said cavities being in communication with said bore.

19. The device of claim 18, wherein said safety valve means further comprises a reservoir into which fluid from said other cavity flows when said valve member is moved towards a first switching position in which the piston associated with said one cavity is operative to adjust said slide block in one direction.

20. The device of claim 19, wherein said safety valve means further comprises an outlet conduit in fluid communication with said high-pressure side of said pump so that pressurized fluid flowing from the latter flows into said outlet conduit and into said other cavity when said valve member is moved towards a second switching position in which the piston associated with said other cavity is operative to adjust said slide block in direction opposite to said one direction.

21. The device of claim 20, wherein said transporting means comprises an additional variable-output pump having a high-pressure side; and further comprising switching means having inlets connected across said high-pressure sides of said respective pumps for selecting which pump generates the higher output pressure, and a single outlet connected with said outlet conduit of said safety valve means.

22. The device of claim 1, wherein said transporting means comprises a plurality of variable-ouput pumps, each of which being separately independently adjustable.

23. The device of claim 1; wherein said transporting means comprises a plurality of variable-output pumps, each of which are independently adjustable in sequence.

* * * * *